US007661665B2

(12) United States Patent
Egli

(10) Patent No.: US 7,661,665 B2
(45) Date of Patent: Feb. 16, 2010

(54) APPARATUS FOR TRIMMING PRINT PRODUCTS

(75) Inventor: Rudolf Egli, Gunzgen (CH)

(73) Assignee: Mueller Martini Holding AG, Hergiswil (CH)

( * ) Notice: Subject to any disclaimer, the term of this patent is extended or adjusted under 35 U.S.C. 154(b) by 96 days.

(21) Appl. No.: 11/806,367

(22) Filed: May 31, 2007

(65) Prior Publication Data

US 2007/0278731 A1 Dec. 6, 2007

(30) Foreign Application Priority Data

Jun. 1, 2006 (EP) ..... 06405246

(51) Int. Cl.
*B65H 29/00* (2006.01)

(52) U.S. Cl. ..... 270/52.17; 270/52.14; 270/52.16; 270/52.19; 270/52.23

(58) Field of Classification Search ..... 270/52.14, 270/52.16, 52.17, 52.19, 52.23
See application file for complete search history.

(56) References Cited

U.S. PATENT DOCUMENTS 3,951,399 A * 4/1976 Reist ..... 270/52.2
RE28,840 E 6/1976 Sarring
4,607,831 A 8/1986 Raybuck
5,826,476 A * 10/1998 Meier ..... 83/155
7,219,794 B2 * 5/2007 Perazzo et al. ..... 198/861.1
7,270,229 B2 * 9/2007 Perazzo et al. ..... 198/550.4
2003/0085503 A1 * 5/2003 Eugster ..... 270/52.19
2004/0201168 A1 * 10/2004 Greive ..... 271/275
2005/0067777 A1 * 3/2005 IIda et al. ..... 271/303
2005/0179189 A1 * 8/2005 Boss ..... 270/52.17

FOREIGN PATENT DOCUMENTS

EP 0 753 386 A1 1/1997
EP 1 563 968 A 8/2005
WO WO 95/02488 A 1/1995

OTHER PUBLICATIONS

EP 06405246.7 Search Report.

* cited by examiner

*Primary Examiner*—Gene Crawford
*Assistant Examiner*—Leslie A Nicholson, III
(74) *Attorney, Agent, or Firm*—Venable LLP; Robert Kinberg; Leigh D. Thelen

(57) ABSTRACT

An apparatus for processing printed products conveyed along a conveying path includes an adjustable positioning device presenting an adjustable guide curve arranged to adjust a position of the printed products along the conveying path.

18 Claims, 3 Drawing Sheets

APPARATUS FOR TRIMMING PRINT PRODUCTS

CROSS-REFERENCE TO RELATED APPLICATION

This application claims the priority of European Patent Application No: 06405246.7-1262, filed on Jun. 1, 2006, the subject matter of which is incorporated herein by reference, together with each U.S. and foreign patent and patent application mentioned below.

BACKGROUND

1. Field of Invention

The present invention relates generally to processing of printer products, and more particularly to a device for positioning the printed products along a conveying path.

2. Description of the Related Art

European Patent Application A-1 563 968, owned by the assignee of the present application, discloses a conventional apparatus used for the trimming and processing printed products. In this apparatus, the printed products are transferred via a conveying device to a conveying rotor, which then supplies the printed products to a trimming device. The device for positioning the printed products, which is incorporated into a rotary trimmer and is herein referred to as a positioning device, has a fixed curved element placed at the bottom of the pockets into which the printed products are inserted. During the transfer, the printed products are deposited on the driven belt of the positioning device. The belt is fitted over several sequentially arranged rollers and forms a curved guide element for positioning the printed products so that they can be gripped by respectively one clamp while in a predetermined position. In order to adapt the guide element to the various formats of the printed product, the sequentially arranged rollers along the curved section can be pivoted manually at the front end of the positioning device, relative to the conveying direction of the printed products, around an axis that extends parallel to the axis of rotation for the conveying rotor.

European Patent Document EP-A-0 753 386 discloses another apparatus for trimming printed products, which also includes a conveying rotor with pockets. In order to position the printed products for the frontal trimming, the pockets containing the respectively deposited printed products must be installed to extend radially, which is a comparatively expensive operation.

What is needed is an apparatus for trimming printed products that allows the position of the printed products to be adjusted for frontal trimming, without a need to rearrange the position of the pockets.

SUMMARY

It is an object of the present invention to provide an apparatus having an adjustable curved guide element that can adapt to the various formats of the printed products. The curved guide element for the apparatus according to the invention is not fixed, but adjustable, meaning the course and/or the shape of the guide element can be adjusted. As a result, the format adaptation and the trimming adaptation can be simplified and made more flexible. The above and other objects are accomplished according to the invention, wherein in one embodiment there is provided an apparatus for processing printed products conveyed along a conveying path, the apparatus comprising: an adjustable positioning device presenting an adjustable guide curve arranged to adjust a position of the printed products along the conveying path.

According to one embodiment of the invention, the positioning device comprises a guide band that forms the adjustable guide curve. In addition, the positioning device includes at least one drive element arranged to act upon the guide band to adjust the guide curve. One advantage of this embodiment is that the form of the curve can be adjusted automatically by using a suitable control device.

According to a further embodiment of the invention, the drive element is provided with a linear drive that executes a lifting movement. A control device may be used to connect the drive elements to the positioning device, so that a precise course of the guide curve can be adjusted.

Yet a further embodiment of the invention provides that a plurality of drive elements are arranged between and attached to two guide plates, thereby resulting in a particularly stable, yet simple and cost-effective design. The drive elements are arranged essentially in the manner of a fan.

Yet another embodiment of the invention provides for the guide band to extend between two deflection rollers, which are arranged at a distance to each other. The deflection rollers can also be adjusted with the aid of a drive element, thus permitting an especially high flexibility for adjusting and changing the guide curve. The guide band is flexible and can be realized extremely cost-effectively in the form of a steel band, for example, consisting of spring steel. It is possible to implement very precise and complicated shapes of the guide curve in this manner. These curves can be adapted one-dimensional or even multi-dimensional, wherein an embodiment is conceivable, for which the band is twisted in a longitudinal direction and three-dimensional curve surfaces are consequently obtained.

Another embodiment of the invention provides for the guide band to extend between two deflection rollers. An endless, driven belt or a chain is fitted over these deflection rollers and the guide band, which makes possible a particularly secure and careful transport of the printed products along the curved band.

The apparatus is especially suitable for trimming printed products, such as magazines, brochures, folded sheets and signatures, and similar products. However, other types of apparatuses are also conceivable for which the printed products must be conveyed and/or transported along a curved course.

Further advantageous features follow from the dependent patent claims, the following description, as well as the drawing.

BRIEF DESCRIPTION OF THE DRAWINGS

These and other features and advantages of the invention will be further understood from the following detailed description of the preferred embodiments with reference to the accompanying drawings.

DETAILED DESCRIPTION

Figure 1:
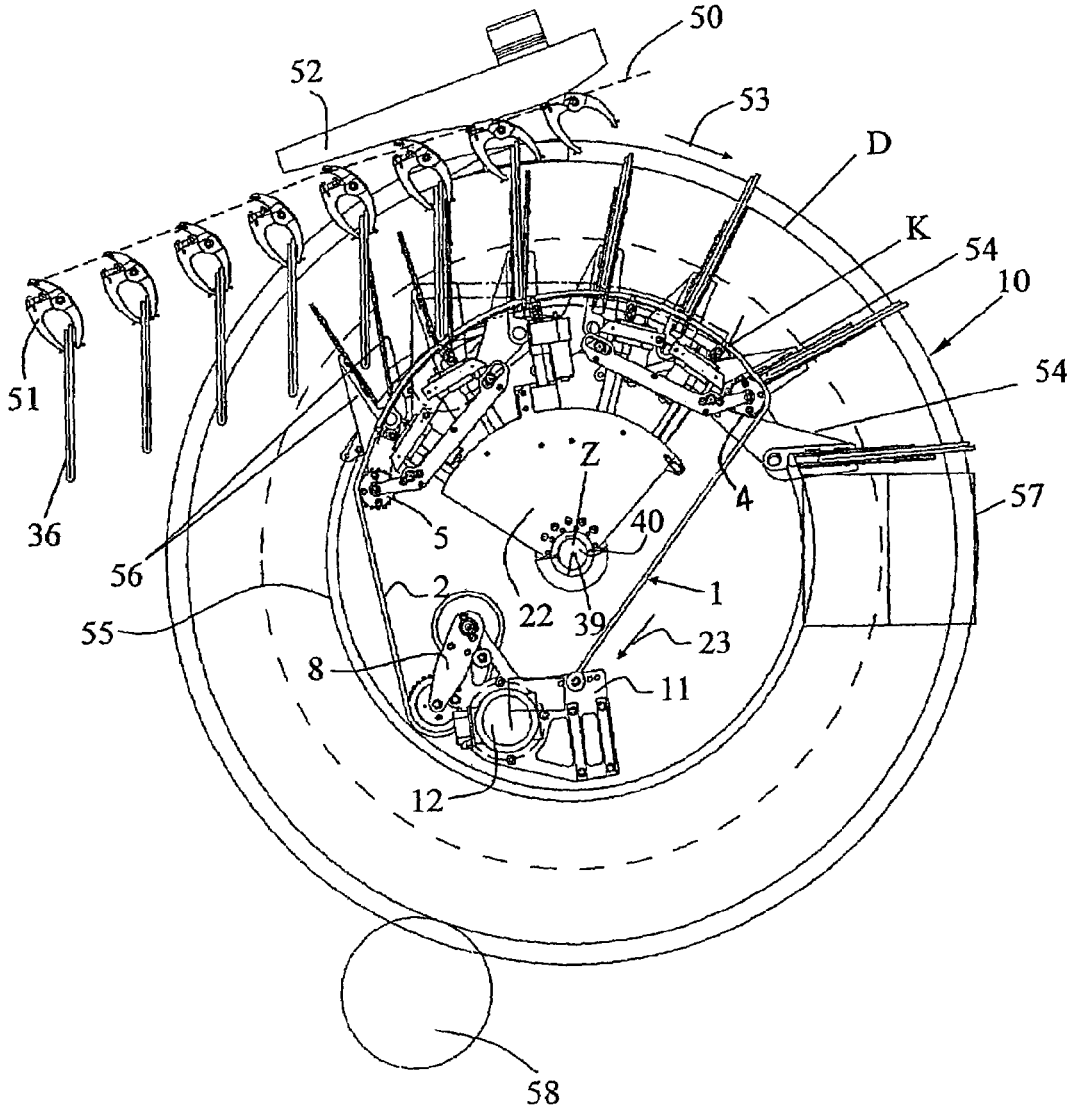
FIG. 1 depicts a schematic side view of the apparatus according to the invention.
Figure 3:
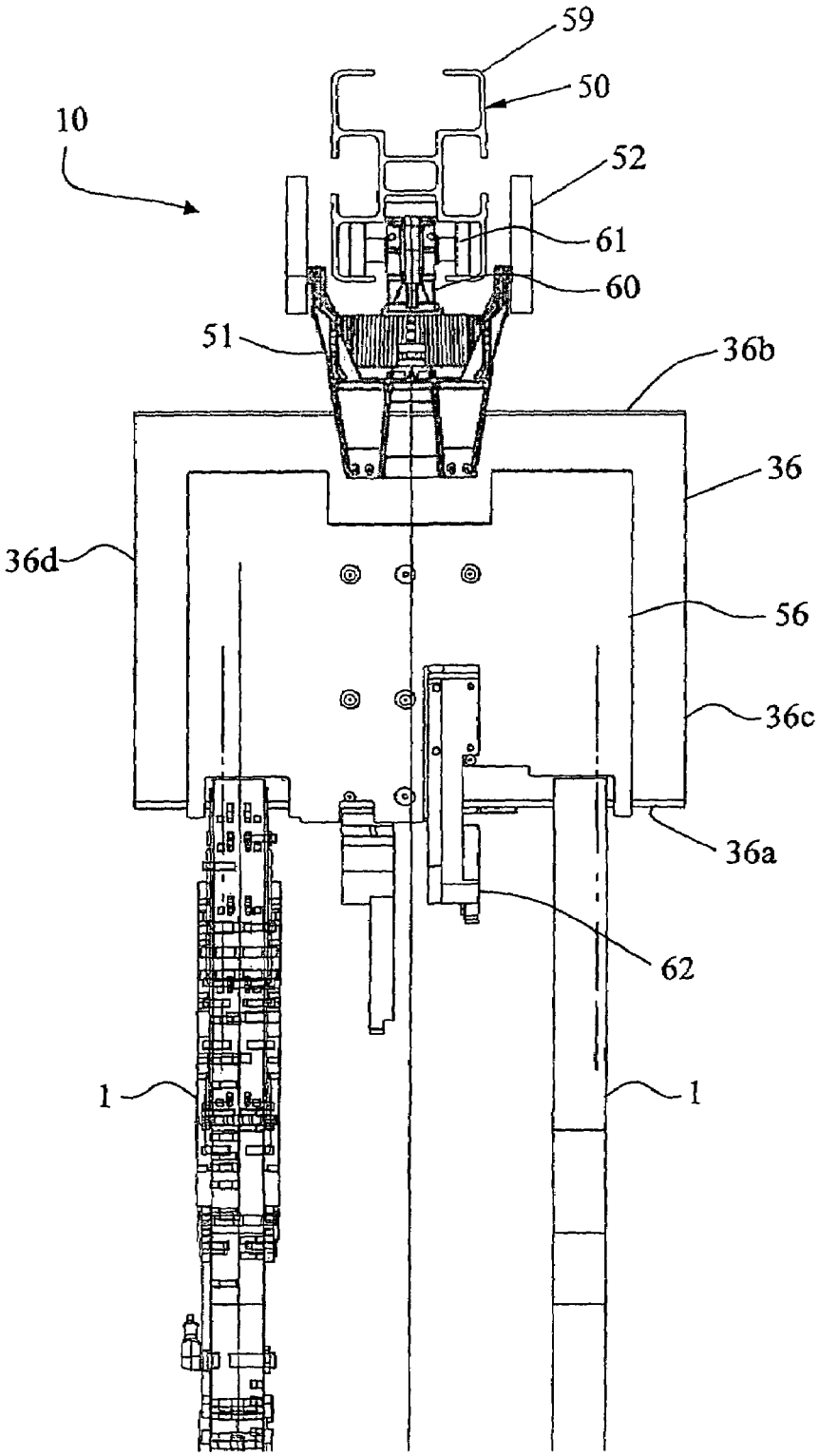
FIG. 3 depicts a schematic partial end view of the apparatus according to FIG. 1.

The apparatus 10, shown in FIGS. 1 and 3, is used in particular for trimming printed products 36, such as newspapers, books, magazines, brochures or parts thereof.

The apparatus 10 functions as a rotary trimmer and is provided with a fan wheel 55, which is positioned to rotate on a shaft 40 and comprises a plurality of pockets 54 along the circumference. These pockets are respectively provided with two flaps 56 which can pivot toward each other. FIG. 1 only shows a few upper pockets 54. The printed products 36 are supplied to the fan wheel 55 with the aid of a conveying device 50 that comprises a plurality of clamps 51 for gripping the printed products 36, wherein these clamps are controlled by clamp-opening curves 52. Referring to FIG. 3, a clamp 51 is provided with a bogie truck 60, equipped with rollers 61, which are guided inside a guide rail 59.

By suitably controlling the clamps 51, the individual printed products 36 are deposited from the top into an opened pocket 54 and are positioned with a lower edge, in this case a fold 36*a*, on a positioning device 1 for positioning the printed products 36. The details of the device 1 will be described later with reference in FIG. 2. Using device 1, the position of printed products 36 can be radially adjusted within the pockets 54 before the closing of the pockets 54 such that their relative position in the pockets 54 is adapted to their format and trimming needs. Consequently, there is no need for the pockets 54 to be moved in radial direction and they need only be opened and closed.

After the fan pocket 54 is closed, the printed products 36 are initially supplied to a first trimming device 57 for trimming the top and bottom edges and subsequently, following a rotation at an angle of approximately 90°, to a second trimming device 58 for trimming the frontal edge. In one embodiment, the second trimming device 58 is a cutting drum, e.g., the cutting drum disclosed in European Patent Document EP 1 563 968 A. Reference D in FIG. 1 denotes the diameter for trimming the printed products 36 along the front edge 36*b*.

Referring again to FIG. 3, two devices 1 are arranged at a distance from each other for depositing the printed products 36 into an open pocket 54. Operating mechanisms 62, which are known in the related art, are arranged between these devices for closing the pockets 54 to clamp in the printed products 36 for the trimming operation. The positioning of the printed products 36 is matched precisely with the closing time of the pockets 54 such that the printed products 36 are clamped by the packets 54. Thus, the positioning of the printed products in the conveying device 50 is similarly adjusted.

The printed products 36 are positioned along guide curves K of the two devices 1 (FIG. 1). The course and thus the shape of the guide curves K can be adjusted independently based on the format of the printed products 36, so that the printed products 36 can be positioned precisely in a radial direction along the guide curves K.

Figure 2:
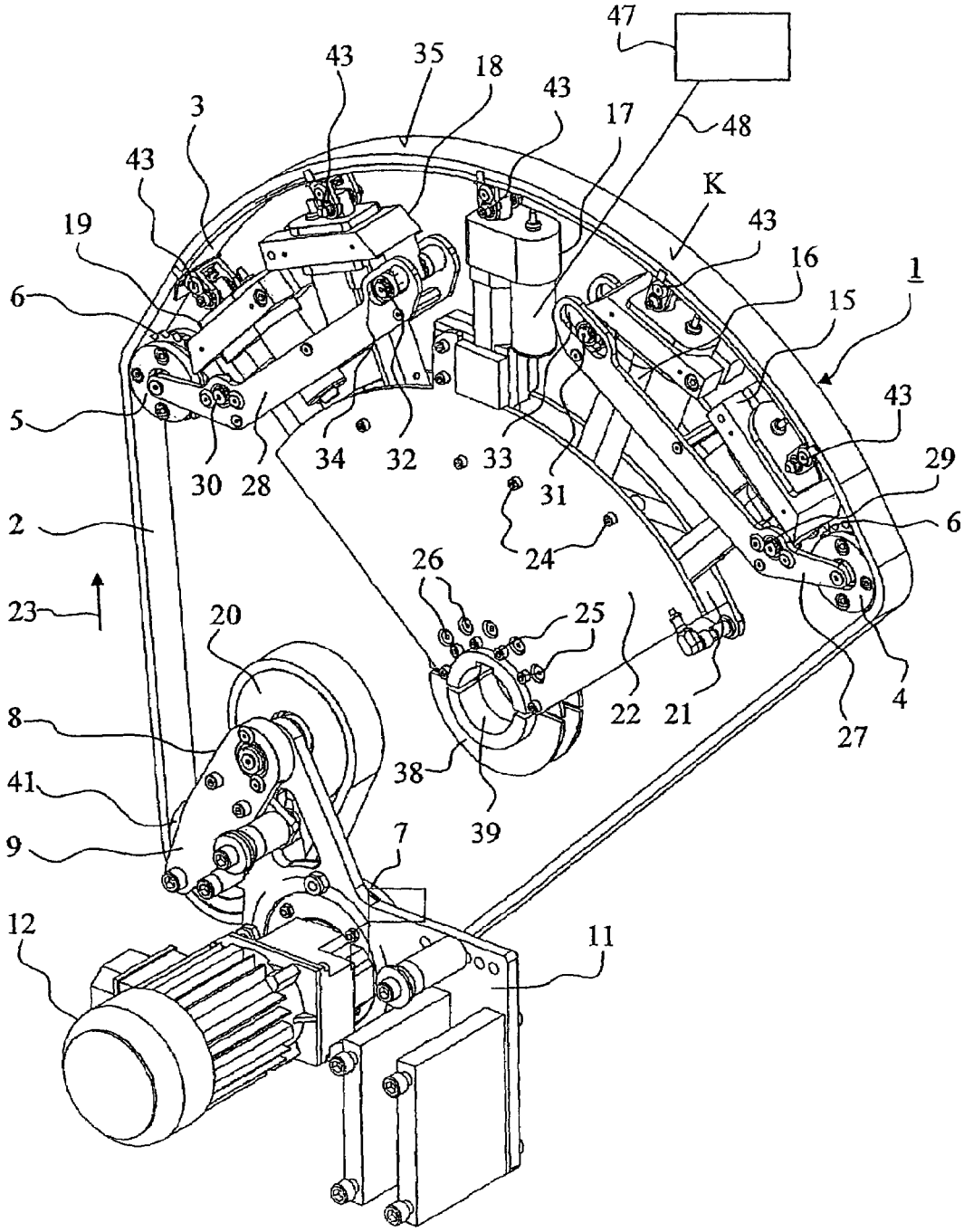
FIG. 2 depicts a three-dimensional view of the device for positioning the printed products.

As shown in FIGS. 1 and 2, each device 1 is provided with an endless belt 2, which can be embodied either as a flat belt or a chain with plate-type elements. This endless circulating belt 2 forms an adjustable curve K between a first deflection roller 5 and a second deflection roller 4. In the area for the guide curve K, the belt 2 is guided on a longitudinal, band-type guide element (i.e., guide band) 3. This guide band 3 is flexible and can be, for example, a spring-steel band, allowing the shape of the guide curve K to be adjusted, as will be explained further in the following text.

The belt 2 is driven in the direction of arrow 23 and is fitted around a drive wheel 7, which is driven by an electric motor 12. The belt 2 is further fitted around rollers 20 and 41, which are positioned on an arm 9 of a tensioning device 8.

Tensioning devices 8 of this type are generally known in the related art and will not be explained further herein. A controllable drive motor 12 can regulate the speed of the belt 2 in accordance with the radius, so that the belt 2 essentially moves at the same speed as the circulating fan pockets 54.

FIG. 2 shows a plurality of drive elements 15 to 19 for changing the guide curve K, where these drive elements are arranged between two plates 21, 22 as shown in FIG. 3 and together form a drive device. The drive elements 15 to 19 are connected with respectively one end via a joint 43 to the guide band 3, such that they can be pivoted. With respectively one spindle that is not shown herein and can be moved in a linear direction, the separate drive elements 15, 16, 18 and 19 are joined at the positions 26 to the plates 21 and 22. Each of the drive elements 15, 16, 18, and 19 can be embodied as an optional, controllable drive. The drive elements 15, 16, 18, and 19 are preferably electric drives, but can also be principally pneumatic or hydraulic drives. The joints 43 can be screwed onto or otherwise connected to the guide band 3.

The automatic adjustment of the two deflection rollers 4 and 5 occurs with the aid of the levers 27 and 28, which are hinged to the two drive elements 15 and 16 and/or 18 and 19. The levers 27 and 28 are respectively connected by a revolute joint 29 and/or 30 to the drive elements 15 and 19. The individual joints 31 and 32 permit a linear displacement of the levers 27 and 28, within the area of an elongated hole 33 and/or 34.

The advantage of this arrangement is that it allows the deflection rollers 4 and 5 to automatically adapt to a change in the guide band 3 and/or to a change in the guide curve K.

The distance bolts 24 and 25 are used to connect the two plates 21 and 22 parallel and at a distance to each other. These two plates 21 and 22 are additionally secured non-rotating on the shaft 40, via a flange 38 with an opening 39. Thus the two plates 21 and 22 are secured in place. The fan wheel 55 rotates around the shaft 40. Similarly, a bearing plate 11 with the motor 12 mounted thereon is secured in place.

The drive elements 15 to 19 are respectively connected via a signal line 48 to a control device 47, which independently controls the positioning of the drive elements 15 to 19.

The drive elements 15 to 19 can be activated individually with the aid of the control device 47, thereby forming a guide curve K that is adapted to the format of the printed products 36. The drive elements 15, 16, 18 and 19 are joined to the respective position 26 such that they can pivot around the position 26 as their position changes. The drive element 17, on the other hand, is fixed in place to prevent such pivoting movement. Consequently, the drive element 17 is oriented in each position toward the center Z and, as a result, the guide band 3 is secured in longitudinal direction.

By controlling the drive elements 15 to 19, it is essentially possible to adjust any optional course for the guide curve K. At each of the five joints 43, the individual guide band 3 can be independently adjusted in the radial direction toward the inside and outside. For example, the guide band 3 can be moved radially toward the outside with the linear drive 15 and radially toward the inside with the linear drive 19. In a further embodiment of the invention, the drive elements 15 to 19 may be designed such that the guide bands 3 are twisted in the longitudinal extension and the guide curve K therefore follows a spatial course.

According to FIGS. 1 and 2, the guide curve K is bow-shaped. However, the guide bands can be designed to take other forms such as, e.g., an S-shaped curve. It is further possible, for example, to adjust only one section of the curve K by using only one of the drive elements 15 to 19, such that one section of the curve would include a convex-shaped section. In yet another embodiment, the drive elements 15 to 19 can be arranged and attached to the guide band 3 so that the top 35 of the belt 2, shown in FIG. 2, is pivoted in longitudinal direction of the guide band 3. Thus, in this embodiment, the guide band 3 may also be twisted in longitudinal direction.

As previously mentioned, the two drive elements 15 and 19 operate the first deflection roller 4 and/or the second deflection roller 5, respectively. In an embodiment, it is conceivable in principle that one or the other of the deflection rollers 4 and/or 5 is immobilized.

The embodiment shown herein comprises five drive elements 15 to 19. However, more or fewer drive elements can in principle also be provided. In one embodiment, it is conceivable to have a device including only one drive element.

In a manner known in the related art, the drive elements 15 to 19 each comprise a distance measuring device not shown herein, so that the control device 47 can respectively determine and control the position of each drive element 15 to 19. Planned guide curves K can thus be controlled and implemented comparatively quickly by using a suitable program.

The guide device 1 can be used, for example, in an apparatus as disclosed in the aforementioned European Patent Application EP-A-1 563 968 for positioning printed products. However, the guide device 1 may also be used in other different conveying devices for which the printed products are guided along a conveying path. The form and/or the course of the guide curve K can be adjusted at any time via the control device 47, without causing an interruption in the operation. A manual readjustment is not necessary, thus making it possible to sequentially process printed products 36 with different formats, without causing any interruption in the operation.

It will be understood that the above description of the present invention is susceptible to various modifications, changes and adaptations, and the same are intended to be comprehended within the meaning and range of equivalents of the appended claim.

What is claimed is:

1. An apparatus for positioning printed products conveyed along a conveying path, the apparatus comprising: an adjustable positioning device presenting an adjustable guide curve to adjust a position of the printed products along the conveying path, wherein the positioning device comprises a guide band that forms the adjustable guide curve and at least one drive element arranged to act upon the guide band to adjust the guide curve, and wherein the at least one drive element is connected at an end to the guide band.

2. The apparatus of claim 1, wherein the guide band is flexible.

3. The apparatus of claim 1, wherein the at least one drive element is configured to execute a lifting movement.

4. The apparatus of claim 3, further comprising a control device connected to the at least one drive element and configured to control the lifting movement of the at least one drive element.

5. The apparatus of 4, wherein the control device is configured to control the lifting movement of the at least one drive element to adjust the position of the guide band.

6. The apparatus of claim 1, wherein the at least one drive element is connected to the guide band via a joint.

7. The apparatus of claim 1, wherein the at least one drive element comprises a plurality of drive elements positioned spaced apart, acting successively upon the guide band.

8. The apparatus of claim 1, further comprising at least one trimming device for trimming the printed products.

9. The apparatus of claim 8, wherein the apparatus is configured to trim a top, bottom, and opening edge of the printed products.

10. An apparatus for positioning printed products conveyed along a conveying path, the apparatus comprising: an adjustable positioning device presenting an adjustable guide curve to adjust a position of the printed products along the conveying path, wherein the positioning device comprises a guide band that forms the adjustable guide curve, first and a second deflection rollers between which the guide band extends, and an endlessly circulating belt fitted over the first and second deflection rollers and the guide band.

11. The apparatus of claim 10, wherein the first and second guide rollers are separately adjustable.

12. The apparatus of claim 10, wherein the endlessly circulating belt comprises a traction mechanism.

13. The apparatus of claim 12, wherein the traction mechanism comprises one of a belt or chain.

14. The apparatus of claim 10, further comprising a controllable drive motor arranged to drive the endlessly circulating belt and configured to vary the speed of the endlessly circulating belt.

15. The apparatus of claim 10, further comprising a fan wheel configured to rotate around a rotating axis, the fan wheel comprising a plurality of pockets arranged at a distance from one another on the circumference of fan wheel, configured to grip printed products conveyed from a conveying device.

16. The apparatus of claim 15, wherein each of the plurality of pockets comprise at least two flaps configured to close at the point of gripping the printed products.

17. The apparatus of claim 16, wherein a closed edge of the printed products is positioned on the endlessly circulating belt before the flaps grip the printed products.

18. An apparatus for positioning printed products conveyed along a conveying path, the apparatus comprising:

an adjustable positioning device presenting an adjustable guide curve to adjust a position of the printed products along the conveying path, wherein the positioning device comprises a guide band that forms the adjustable guide curve and at least one drive element arranged to act upon the guide band to adjust the guide curve; and a plate fixed to a machine frame, wherein a first end of the at least one drive element is hinged to the plate via a first joint and a second end of the at least one drive element is connected to the guide band via a second joint to act upon the guide band.

* * * * *